United States Patent [19]

Knight

[11] Patent Number: 4,697,638

[45] Date of Patent: Oct. 6, 1987

[54] DOWNHOLE LOGGING AND SERVICING SYSTEM WITH MANIPULATABLE LOGGING AND SERVICING TOOLS

[75] Inventor: Orien M. Knight, Joshua, Tex.

[73] Assignee: Gearhart Industries, Inc., Fort Worth, Tex.

[21] Appl. No.: 821,407

[22] Filed: Jan. 22, 1986

[51] Int. Cl.[4] ..... E21B 43/00

[52] U.S. Cl. ..... 166/65.1; 166/250; 166/237

[58] Field of Search ..... 166/65.1, 64, 383, 242, 166/113, 240, 237, 381, 250, 104; 175/92, 107, 4.51

[56] References Cited

U.S. PATENT DOCUMENTS

| | | | |
|---|---|---|---|
| 3,519,075 | 7/1970 | Mullins | 166/237 |
| 4,200,297 | 4/1980 | Tricon | 166/65.1 X |
| 4,349,072 | 9/1982 | Escaron et al. | 166/250 |
| 4,388,969 | 6/1983 | Marshall et al. | 166/65.1 X |
| 4,457,370 | 7/1984 | Wittrisch | 166/65.1 X |
| 4,566,535 | 1/1986 | Sanford | 166/250 X |

*Primary Examiner*—Stephen J. Novosad
*Assistant Examiner*—Thuy M. Bui
*Attorney, Agent, or Firm*—Hubbard, Thurman, Turner & Tucker

[57] ABSTRACT

Disclosed is a downhole logging and servicing system with manipulatable logging and servicing tools. The system includes a conveyor for running the tools into and out of the well bore and a manipulating apparatus operable responsive to fluid pressure to manipulate the tools. The manipulating apparatus includes a fluid operated incremental rotating device connected to the conveyor and control device operated by the rotating device to manipulate the tools.

25 Claims, 10 Drawing Figures

DOWNHOLE LOGGING AND SERVICING SYSTEM WITH MANIPULATABLE LOGGING AND SERVICING TOOLS

BACKGROUND OF THE INVENTION

A. Field of the Invention

The present invention relates generally to apparatus and methods for logging and servicing bore holes and more particularly to an apparatus and method for logging and serving both vertical and highly deviated bore holes with logging or servicing tools run into the bore hole on the end of a string of pipe which allows the logging or servicing tools to be manipulated with respect to the string of pipe.

B. Description of the Prior Art

An important aspect of the field of drilling, completing, and servicing oil and gas wells involves the use of well logging and well servicing instruments. These instruments are commonly called tools and the operation of these tools is referred to as logging or servicing. Logging involves placing tools in the bore hole drilled in the earth for the purpose of locating or identifying subterranean formations and extracting oil, gas, water, or other minerals. For example, some of these tools or combinations of tools are used to evaluate general lithological structure, including formation resistivity, porosity, matrix, or fluid or gas content. Measurements include acoustics, resistivity, temperature, pressure, natural radiation, induced radiation, and many others. Other tools are used for core sampling, cementing, perforating casing or tubing, and other tests.

In some instances, it is necessary that the tool be positioned in a certain relationship to the bore hole wall. For example, compensated density tools and compensated neutron tools have a pad that is extendd outwardly from the tool into contact with the bore hole wall. The pad must be in such contact in order for the tool to preform properly. Other tools, such as mandrel neutron tools, require close proximity to the bore hole wall. Core sample tools require an optimum spacing from the bore hole wall in order to achieve maximum efficiency. In other instances, centralization in the bore hole is required for operation of such tools as dip meters or sonic tools.

Several systems are used to transport tools into and out of bore holes in order to perform their specialized operations. One conventional system uses a wireline as the conveyer. The wireline includes at least one conductor for providing electric communication for the tool to the surface and the tool is lowered on the wireline by gravity into a position to log the bore hole. In many cases of deviated holes with inclinations above 55 degrees, and in some cases less depending upon hole conditions, gravity does not provide sufficient force to move the tools down the hole and wireline logging is impossible.

A system that has been developed to log highly deviated tools includes positioning a string a drill pipe near the zone of interest and pumping a wireline with an assembly of small diameter tools out the bottom end of the drill pipe and allowing the tools to fall by gravity through the zone of interest. A very high angle bore hole can be traversed by this method as long as the open hole inclination in the zone of interest is low in angle and hole conditions permit the tool to fall by gravity. The bore hole is logged by extracting the cable and pulling the tool through the zone of interest. The pump down system is of limited untility because the small sized tools are typically of lesser quality as regards to accuracy and quality of measurement than are the larger suites of tools used in conventional wireline operations. Also, the pump down system is limited to certain hole profiles and relatively short logging zones. Additionally, the tools may be lost due to sticking. A further shortcoming of the pump down system lies in the fact that gravity provides the only means for orienting the tools.

Another system for logging high angle bore holes is disclosed in Escaron U.S. Pat. No. 4,349,072, in which the tools are lwored using a drill pipe as the conveyer and pumping an extension with a wet connector down the drill pipe into electrical connection with the tools. The tools are released and moved axially into the bore hole with respect to the drill pipe. The hole is logged by pulling the tool back into the drill pipe with a wireline. In Barry, et al. U.S. Pat. No. 3,957,118, measurement-while-drilling-type logging is conducted using a wet connector and cable stored within the drill pipe. The tools are secured at the lower end of the drill pipe above the bit and tool positioning is controlled and limited by the drilling operation.

Base U.S. Pat. No. 4,062,551, Tricon U.S. Pat. No. 4,200,297, and Marshall U.S. Pat. No. 4,388,969 each disclose systems that include a side-entry sub secured in the drill string to provide communication between tools and the surface by means of a wireline. The tools are pumped down the drill pipe to a predetermined location and the tools are conveyed into and out of the well bore by adding and removing drill pipe above the side-entry sub. Initially, the above systems were used in connection with steering tools in bent sub mud motor drilling. More recently, as disclosed by the Marshall U.S. Pat. No. 4,388,969, the systems have been used in logging. Wittrisch U.S. Pat. No. 4,457,370 discloses a system similar to what is disclosed in Marshall U.S. Pat. No. 4,388,969 and Barry, et al. U.S. Pat. No. 3,957,118 or Escaron U.S. Pat. No. 4,349,072, in which the tools are secured to the bottom of the drill string and a wet connector is pumped down to the tools via a side-entry sub. Again, the tools are conveyed into and out of the well bore by adding and removing sections of drill pipe above the side-entry sub. The tools are oriented within the well bore by rotating the drill string.

In practice, especially in deviated holes with depths from 3,000 to 20,000 feet or more, rotation or other manipulation of the drill string from the surface in order to orient tools at the bottom of the drill string is impractical due to the elasticity of the drill pipe and drag on the bore hole walls. Although orientation can be achieved with some difficulty, it is extremely difficult to maintain that orientation. The difficulty in maintaining the orientation is primarily due to torque build up in the drill string during the act of rotation from the surface. Normally, after logging a few hundred feet or less, the build up of torque or torque generated by moving the drill pipe through a corkscrew profile will rotate the tool out of position. Positioning the tool becomes even more difficult once the side-entry sub has been lowered into the well bore. After the side entry sub has been lowered, the wireline extends up to the surface along the outside of the drill pipe. With the wireline in the annulus, it is preferable not to rotate the drill string because such rotation can wrap the wire line about the drill string which can result in damage to the wire line or prevent its emergency extraction.

It is therefore an object of the present invention to provide an apparatus and method for logging bore holes and servicing wells that overcomes the shortcomings of the prior art. More particularly it is an object of the present invention to provide an apparatus and method for logging bore hole formations and servicing wells that is applicable from vertical through high deviations that are not accessible with standard wireline techniques. It is a further object of the present invention to provide a conveyer for positioning tools in a well bore that allow for rotation or other manipulation of the tools to selected orientations without rotating or manipulating the conveyer at the surface. It is yet a further object of the present invention to provide an improved system for performing downhole operations.

SUMMARY OF THE INVENTION

Briefly stated, the foregoing and other objects are accomplished by the apparatus and method of the present invention. The invention includes a conveyor that is adapted for movement into and out of the well bore. An incremental rotating device is attached to the conveyor and selected control devices are connected to the incremental rotating device. Logging or servicing tools are in turn attached to and operated by the control devices. The conveyor may be moved back and forth within the bore hole between the surface and the zone of interest to perform logging and servicing operations. The conveyor is adapted to provide fluid pressure to the incremental rotating device to cause the incremental rotating device to rotate through a predetermined radial angle. The rotation of the incremental rotation device causes the control device to manipulate or otherwise operate the logging or servicing tools. The conveyor is preferably a string of drill pipe, but it may also be conduit, rods, tubing, slickline, or electric wireline. The fluid pressure is preferably provided by surface pumps via the drill pipe conveyor, but it may also be provided by a hose or conduit when the conveyor is a wireline, slickline or rod, or by a downhole pump.

In one aspect of the invention, the control device transmits rotation from the incremental rotation device directly to the logging tool. The incremental rotation device is affixed to the conveyor and sequential application of hydraulic or fluid pressure to the incremental rotation device causes the incremental rotating device, through the control device, to rotate the tools to a selected radial attitude. In another aspect of the invention, the control device includes means for converting rotational movement into translational movement which is adapted ot extend or project tool elements outwardly to perform logging or servicing operations. The control device is also adapted for translating rotational movement into translational movement to operate various downhole tools. In yet another aspect of the invention, a control device is provided to release tools into the wellbore.

The rotating device includes a body connectable to the string and a mandrel rotatably mounted in the body and connectable to the tool assembly. A drive piston is axially slidingly disposed between the body and the mandrel and the device includes means for transmitting rotational forces to the mandrel in response to axial movement of the drive piston. Broadly, the rotational force transmitting means includes a ratchet sleeve nonrotatably engagaeable with the mandrel. The ratchet sleeve has a slot formed therein and the slot has a helical portion. A drive pin is axially movably carried with the drive piston and is in engagement with the slot. Thus, axial movement of the drive piston is translated into rotational movement of the mandrel through the cooperation of the pin and slot. Preferably, the rotating device includes means for preventing rotation of the mandrel with respect to the body when the drive piston is in either of its extreme positions with respect to the body and mandrel.

DESCRIPTION OF THE PREFERRED EMBODIMENT

Figure 1:
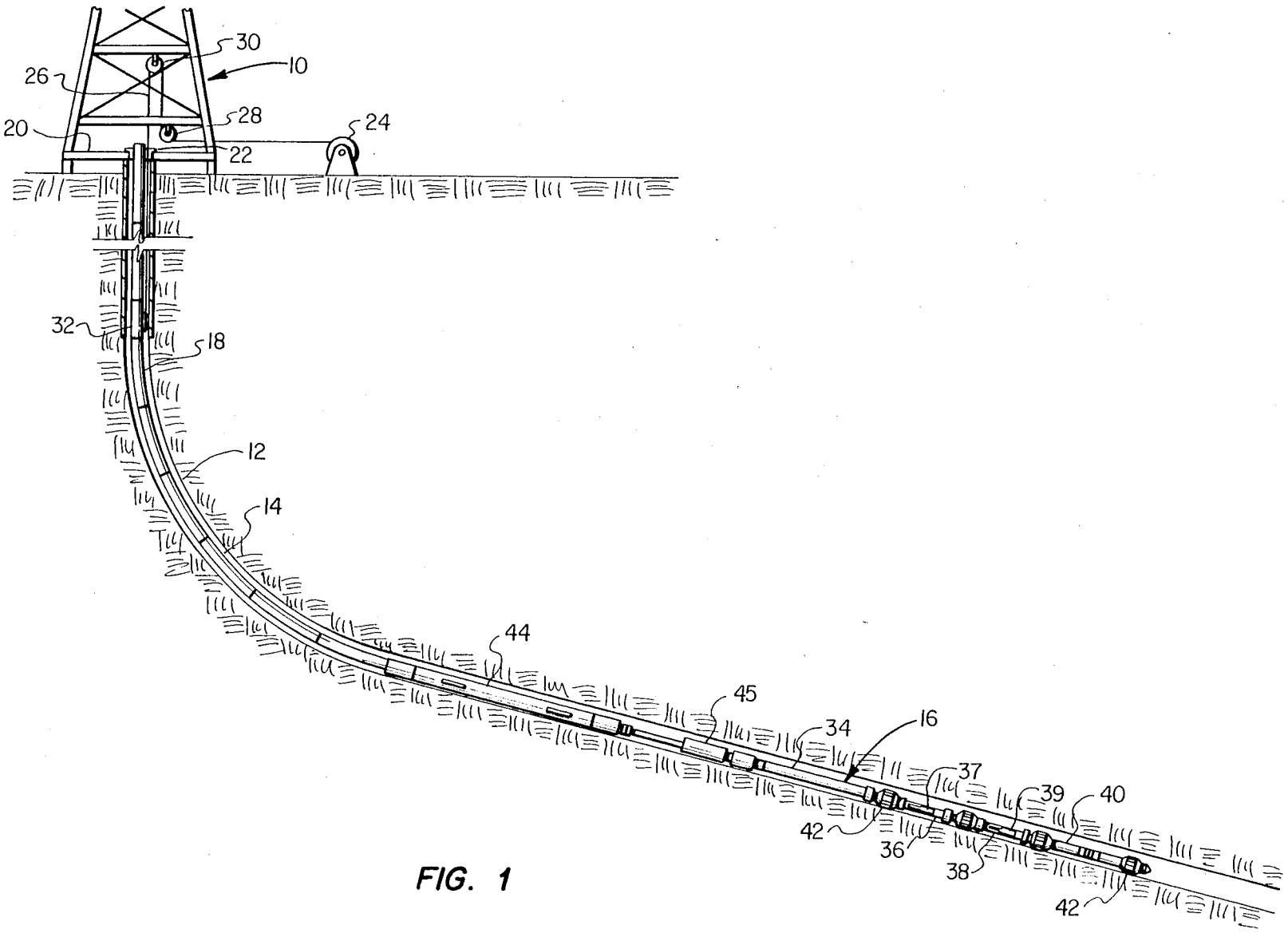
FIG. 1 is a schematic view of a deviated well bore showing the environment of the present invention.

Referring now to the drawings, and first to FIG. 1, a drilling rig 10 is shown above a well bore 12. The lower portion of well bore 12 is deviated at a high angle away from the vertical. An elongated drill string 14 extends down into well bore 12 and has a logging tool assembly 16 attached to its lower end. Drill string 14 is made up of a plurality of end-to-end connected sections of pipe, each designated by the numeral 18.

Drill string 14 extends down through the floor 20 of rig 10 into well bore 12. A conventional rotary table and slip assembly 22 for rotating and supporting drill string 14 is shown. A power wench assembly 24 is connected to an elongated cable or wireline 26 and is suitable for paying out and reeling in the cable. Cable 26 passes over suitable sheaves 28 and 30 in rig 10 and into well bore 12 adjacent drill string 14. A side-entry sub 32 is provided in drill string 14 so that cable 26 may enter the interior of drill string 14.

Logging tool assembly includes a protective sleeve encompassing one or more downhole logging tools. In the example shown in FIG. 1, logging tool assembly 16 includes a gamma ray tool 34 for measuring the natural radioactivity of the formation. Logging tool assembly 16 also includes a compensated neutron tool 36 and a compensated density tool 38. Compensated neutron tool 36 includes a pad 37 that is adapted to be extended radially outwardly through slots in the protective sleeve to make contact with the well bore wall. Similarly, compensated density tool 38 includes a pad that is likewise adapted to be extended radially outwardly into contact with the well bore wall. Generally, the compensated neutron tool measures the hydrogen concentration in the formation, which is indicative of the amount of petroleum and water in the formation. Compensated density tool 38 measures the electron density in the formation, which is related to the true bulk density of the formation. Finally, logging tool assembly 16 includes an inductive logging device 40 which measures the resistivity of the formation.

Logging tool assembly 16 includes along the length of its protective sleeve a plurality of stabilizers 42, which are preferably rotatable with respect to assembly 16. Stabilizers 42 are included in order to keep the bodies of the various logging devices from rubbing against the bore hole wall and to provide a degree of centralization of logging tool assembly 16 and provide a bearing surface during rotation. Fluted stabilizers are shown, but well known spring stabilizers and so-called "rubbers" are suitable.

Those skilled in the art will recognize that logging tool assembly 16 may include other or alternative logging devices and that the composition of logging tool 16 as shown in FIG. 1 is for purposes of illustration only. Also, for purposes hereof, the term logging tool is used in a broad sense to include such devices as core samplers, perforating guns, and other downhole tools.

In positioning logging tool assembly 16 for performing logging operations, or other procedures in accordance with the particular type of tool being used, the tool is typically lowered to the upper portion of the zone of the well bore to be surveyed and the side-entry sub 32 is added to the drill string 14. Wireline cable 26 is then inserted through a suitable port in side-entry sub 32 and lowered or pumped down the interior of drill string 14 for electrical connection to logging tool assembly 16 by means of a latch or connector assembly (not shown). After wireline cable 26 is connected to logging tool assembly 16, additional lengths of pipe 18 are connected in end-to-end fashion above side-entry sub 32, thereby to run logging tool assembly 16 into bore hole 12 below the zone of interest. The zone of interest is then logged by removing sections of pipe 18.

As shown in FIG. 1, logging tool assembly 16 tends to lie on the low side of well bore 12. Certain of the tools of logging tool assembly 16 need to be in relatively close proximity to the walls of well bore 12 in order to operate properly. For example, pads 37 and 39 of compensated neutron tool 36 and compensated density tool 38, respectively, need to be in actual contact with the well bore wall. Pads 37 and 39 are shown in FIG. 1 displayed about 90 degrees from the low side of the hole; however, they could be oriented at virtually any other angle with respect to the low side of the hole, as for example 180 degrees or toward the high side of the hole. Centralization of logging tool assembly 16 is impractical because of the large weight of logging tool assembly at the end of drill string 14. Also, since normal continuous rotation, circulation, and reciprocation of the drill string cannot be accomplished, centralization of the lower section of drill string 14 adds to the potential of sticking, which could result in the loss of a portion of the drill string and tools. Rotation of pads 37 and 39 toward the low side of the hole by rotating drill string 14 at rotary table 22 is generally impracitcal since drill string 14 tends to twist and store tortional stresses over its length. Generally, rotation of the end of drill string 14 at rotary table 22 through a given angle results in the rotation of logging tool assembly 16 through a much smaller angle. However, as drill string 14 is pulled out of bore hole 12, the tortional stresses are relieved and logging tool assembly 16 rotates. Also, rotation of drill string 14 at rotary table 22 is generally unsatisfactory in that it cause wireline cable 26 to wrap about drill string 14. Accordingly, in the present invention, an incremental rotating apparatus 44 and control device 45 are provided for rotating logging tool assembly 16 with respect to drill string 14.

Figure 2A:
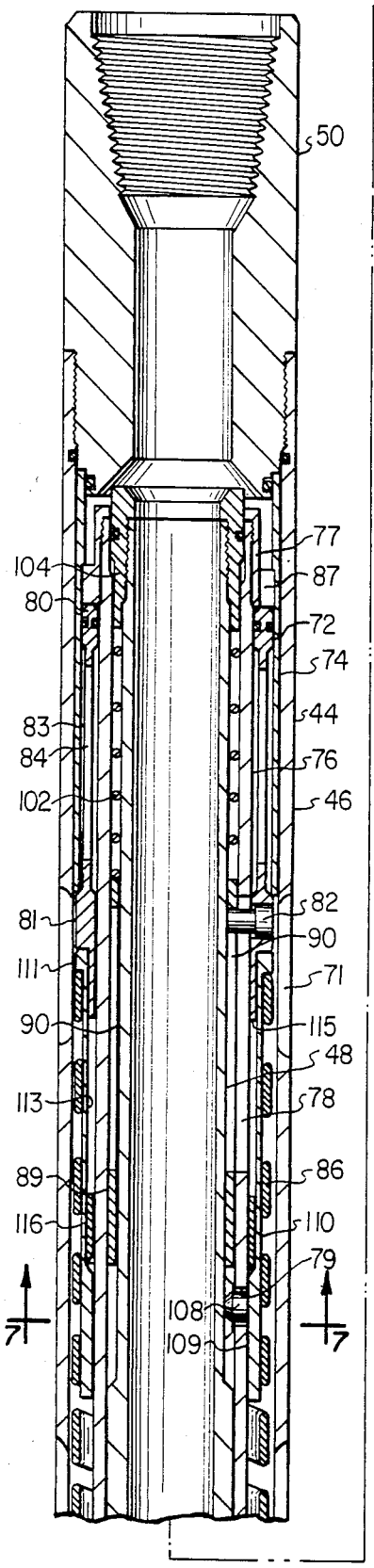
FIGS. 2A–C are sectional views of the rotating device of the present invention.
Figure 2B:
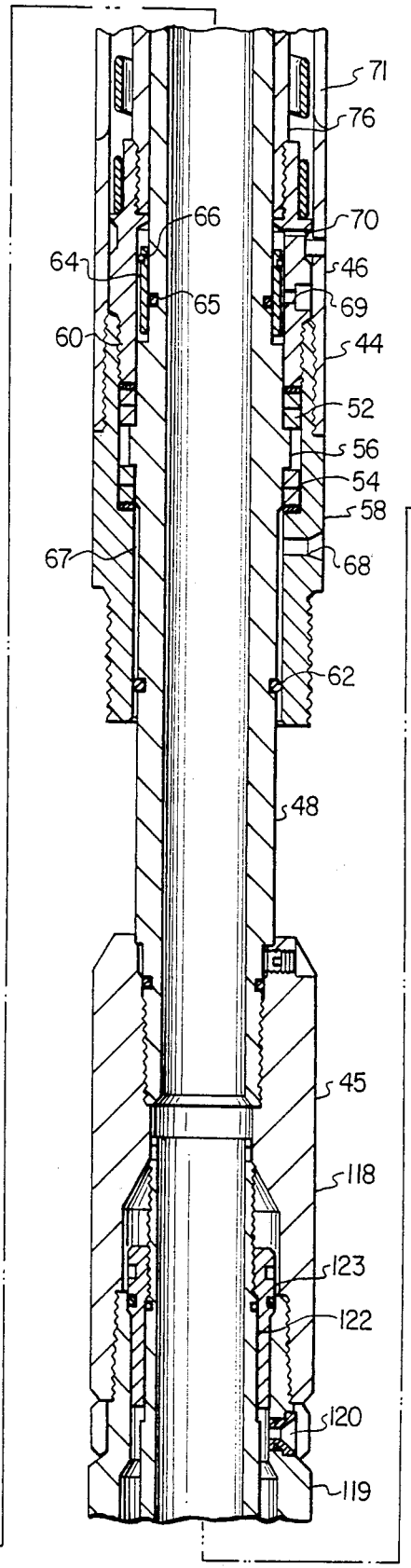
Figure 2C:
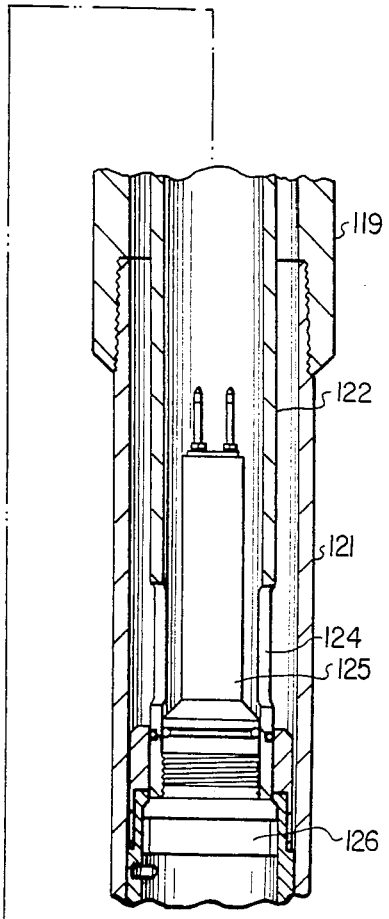

Referring now to FIGS. 2A–C, incremental rotating apparatus 44 generally includes a tubular body 46 and a tubular mandrel 48 mounted within body 46. Body 46 is connectable at its upper end to a drill string by means of an internally threaded upper member or coupling 50. The lower end of mandrel 48 is externally threaded for connection to logging tool assembly 16.

Mandrel 48 is rotatably mounted within body 46 by means of bearings 52 and 54. Mandrel 48 includes a radially outwardly extending annular shoulder 56 supported between bearings 52 and 54. A bearing sub 58 is threadedly engaged to body 46 to support lower bearing 54 and a bearing retainer 60 is threadedly engaged to bearing sub 58 to retain upper bearing 52 against shoulder 56. A seal 62 is provided for sealing between mandrel 48 and bearing sub 58 below lower bearing 54. A compensating piston 64 is disposed between mandrel 48 and bearing retainer 60 above upper bearing 52. Seals 65 and 66 are provided between mandrel 48 and compensating piston 64 and compensating piston 64 and bearing retainer 60, respectively. Seal 62 and compensating piston 64 form therebetween a lubrication chamber 67 that is filled with an oil to lubricate bearings 52 and 54. Oil may be introduced into and bled from lubrication chamber 67 through ports 68 and 69 in bearing sub 58 and bearing retainer 60, respectively. Compensating piston 64 serves to maintain the pressure within lubrication chamber 67 at ambiant pressure. At least one port 70 is formed in bearing retainer 60 to allow for communication of pressure to compensating piston 64. A plurality of ports 71 are formed in body 46 to allow for equalization of pressure within body 46.

Referring particularly to FIG. 2A, mandrel 48 is incrementarlly rotatable with respect to body 46 by means of a ratcheting system which includes an annular drive piston 72 disposed generally between a piston sleeve 74 and a guide sleeve 76. Guide sleeve 76 is positioned about mandrel 48 and is threadedly engaged at its lower end with bearing retainer 60 and at its upper end with a piston stop 77. Guide sleeve 76 includes at least one axially extending guide slot 78 and a plurality of detent apertures 79. Piston sleeve 74 is retained in body 46 between upper member 50 and piston stop 77 and provides a sealing bore for piston 72.

Piston 72 includes an upper sealing portion 80 having appropriate seals for sealing engaging piston sleeve 74 and guide sleeve 76 and a lower portion 81 which carries a plurality of drive pins 82. Drive pins 82 engage guide slot 78 in guide sleeve 76, thereby to prevent rotation of drive piston 72 with respect to guide sleeve 76 and body 46. Drive piston 72 includes a central portion 83 having a plurality of axially extending pressure compensation ports 84 therein.

Drive piston 72 is normally urged axially upwardly into contact with piston stop 77 by means of a piston return spring 86. Piston stop 77 includes a plurality of flow passages 87 which communicate fluid pressure from the interior of body 46 to drive piston 72. When the pressure on drive piston 72 is sufficient to overcome the force of piston return spring 86, drive piston 72 is driven axially downwardly within body 46 to the position shown in FIG. 3. When the pressure is reduced, piston return spring 86 drives piston 72 back to the position of FIG. 2A. The cooperation of drive pin 82 in guide slot 78 prevents piston 72 from rotating with respect to body 46.

The axial movement of drive piston 72 is transmitted to mandrel 48 through a ratchet sleeve 89, which is disposed between mandrel 48 and guide sleeve 76. Ratchet sleeve 89 includes a plurality of slots 90 which are engaged by drive pins 82. Referring particularly to FIG. 4, each slot 90 includes an axially extending first portion 92, a helically extending portion 93, and an axially extending third portion 94. As drive piston 82 moves axially from the position of FIG. 2A to the position of FIG. 3, drive pins 82 travel first through first portion 92 of slot 90, then through helical portion 93, and finally through third portion 94. Since drive pins 82 are constrained to move axially, the movement through helical portion 93 imparts rotational motion to ratchet sleeve 89. The rotational movement of ratchet sleeve 89 is normally transmitted to mandrel 48 by a plurality of serrated locking ratchets formed at the lower end of ratchet sleeve 89 which engage a plurality of ratchet pawls 98 formed on mandrel 48. Locking ratchets 96 and locking pawls 98 have complimentary axially extending engagement surfaces 97 and 99, respectively, and complimentary helical surfaces 100 and 101, respectively.

Referring again to FIG. 2A, ratchet sleeve 89 is normally urged into engagement with locking pawls 98 by a ratchet return spring 102. Ratchet return spring 102 is compressed against ratchet sleeve 89 by a ratchet spring retainer 104 threadedly engaged with the upper end of mandrel 48. The rotational movement to ratchet sleeve 89 as drive pins 82 move through helical portions 93 of slots 90 is transmitted through axial surfaces 97 and 99 of locking ratchets 96 and locking pawls 98, respectively, to mandrel 48. As drive pins 82 move axially upwardly from the position of FIG. 3 back through helical portions 93 toward the position of FIG. 2A, ratchet sleeve 89 is lifted and rotated about mandrel 48. When drive pins 82 move into the axial first portions 92 of slots 90, ratchet return spring 102 urges ratchet sleeve 89 back into engagement with locking pawls 98.

Figure 3:
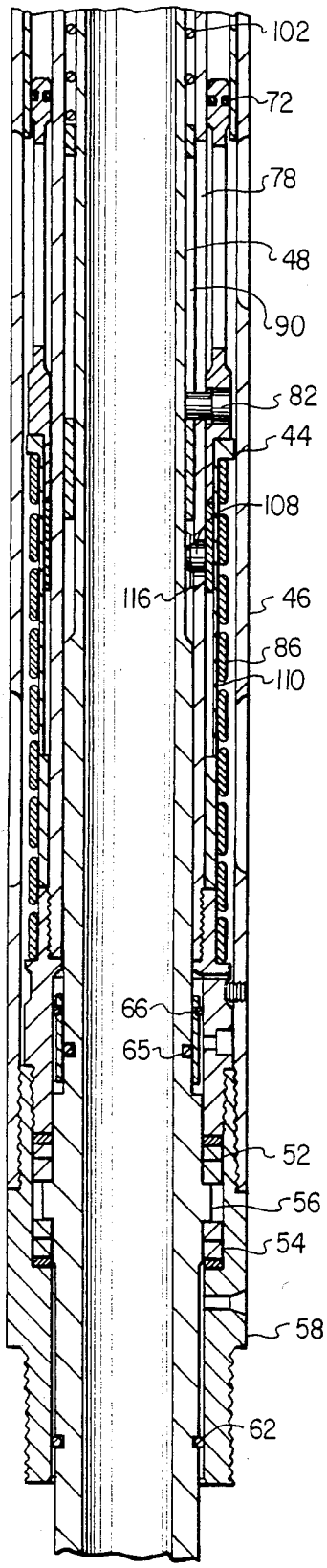
FIG. 3 is a partial sectional view of the rotating device of the present invention showing the drive piston in its fully inward position.
Figure 4:
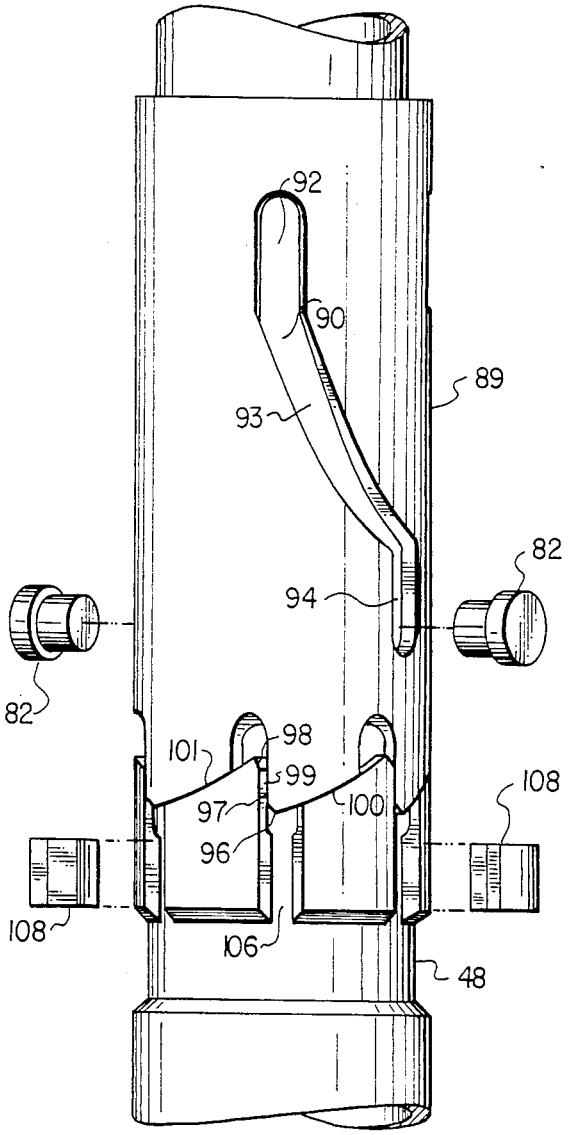
FIG. 4 is a perspective view showing details of a portion of the rotating device of the present invention.

Mandrel 48 is prevented from rotating with respect to body 46 when piston 72 is in its first, outward, position, as shown in FIG. 2A and in its second, inward, position shown in FIG. 3, and during movement of piston 72 from the second position to the first position. In other words, means are provided so that mandrel 48 is rotatable with respect to body 46 only when piston 82 moves from the first position, as shown in FIG. 2A, to the second position, as shown in FIG. 3.

Figure 7:
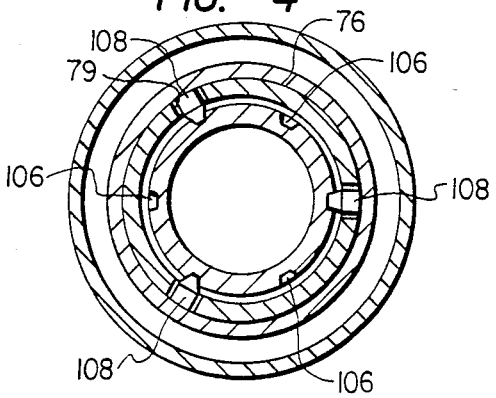
FIG. 7 is a view taken generally along line 7—7 of FIG. 2A.

Referring particularly to FIG. 7, the rotation preventing means includes a plurality of detent recesses 106 formed in mandrel 48. Preferably, detent recesses 106 are defined in the spaces between locking pawls 98. Detent recesses are engaged by a plurality of detents 108 radially movably carried in detent apertures 79 of guide sleeve 76. When drive piston 82 is in its first position, shown in FIG. 2A, detents 82 are held radially inwardly in engagement with detent recesses 106 by a radially inwardly enlarged surface 109 of a locking sleeve 110. Locking sleeve 110 is disposed about guide sleeve 76 and includes a radially outwardly extending flange 111 positioned between lower portion 81 of drive piston 72 and piston return spring 86. As drive piston 72 is urged axially downwardly, surface 109 of locking sleeve 110 moves out of engagement with detents 108, thereby allowing detents 108 to move radially into an enlarged portion 113 of locking sleeve 110 when piston 72 has moved a distance equal to the length of first axial portion 92 of slot 93 of ratchet sleeve 89. As drive pins 82 traverse the helical portion 93 between axial portions 92 and 94 of slot 90, mandrel 48 is free to rotate with respect to body 46. As drive pins 82 reach axial third portion 94 of slot 90, the lower end 115 of drive piston 72 reaches a floating sleeve 116 disposed between guide sleeve 76 and locking sleeve 110 in enlarged portion 113. Continued movement of drive pins 82 in axial third portion 94 moves floating sleeve 116 axially into engagement with detents 108 to urge detents 108 radially inwardly back into engagement with detent recesses 106, as shown in FIG. 3. As piston return spring 86 urges drive piston 72 from its second position back to its first position, floating sleeve 116 remains in engagement with detents 108 until floating sleeve 116 is moved axially upwardly by the lower portion of locking sleeve 110, whereupon surface 109 again engages detents 108.

To summarize the operation of rotating apparatus 44, when it is desired to rotate logging tool assembly 16 with respect to drill string 14, the pressure of fluid within body 46 of rotating apparatus 44 is increased to drive drive piston 72 axially from its first position, as shown in FIG. 2*a*, toward its second position, as shown in FIG. 3. Axial movement of drive piston 72 causes movement of drive pins 82 within slot 90 of ratchet sleeve 89 and causes movement of locking sleeve 110 to release detents 108 from detent apertures 106, which allows mandrel 48 to rotate with respect to body 46. Movement of drive pins 82 through helical portion 93 of slot 90 causes mandrel 48 to rotate through an angle equal to the angular separation between first portion 92 and third portion 94 of slot 90. When drive pins 82 reach the lower end of helical portion 93 of slot 90, floating piston 116 urges detents 108 back into engagement with detent recesses 106, thereby preventing further rotation of mandrel 48. When the pressure within body 46 is relieved, piston return spring 86 urges drive piston 72 back to its first position. Thus, mandrel 48 can be rotated incrementally with respect to body 46 by successive applications of pressure.

Referring to FIGS. 2B and 2C, control device 45 includes an extension sub 118 threadedly engaged to the lower end of mandrel 48. A port sub 119 is threadedly engaged to extension sub 118 and includes a plurality of ports 120 for the circulation of fluid from the interior to the exterior of port sub 119 and for creating sufficient backpressure to operate incremental rotation device 44. Port sizes may be selected to develope sufficient pressure for rotation over a range of mud weights and flow volumes. A tubular protective sleeve 121 is threadedly engaged to port sub 121 and extends axially to protect and contain the logging tool assembly 16. A tubular connector guide 122 is supported within extension sub 118, port sub 119, and protective sleeve 121 by means of a tool hanger 123. Connector guide 123 includes a plurality of ports 124 for the flow of fluid into the annular space between protector sleeve 121 and connector guide 122 and eventually out ports 120 of port sub 119. Connector guide 122 supports at its lower end a connector 125 which establishes electrical connection with a tool 126.

In operation, tool assembly 16 is affixed at the surface to control device 45, which in turn is affixed to incremental rotating apparatus 44. The assembly thus formed is in turn affixed to the end of drill string 14, which is run into well bore 12 to a point above the zone of interest. Then side-entry sub 32 is connected to drill string 14 and wireline 26 is inserted into side-entry sub 13 and lowered or pumped through drill string 14 to establish connection with logging tool assembly 16. Then, additional stands of pipe are added to drill string 14 above side-entry sub 32 thereby to move logging tool assembly down the borehole and through the zone of interest.

In the foregoing example, tool assembly 16 is secured only in axial relationship to drill pipe 14 and can be incrementally rotated by providing a sequence of circulating mud pulses through the drill pipe and control device port sub 119. The hydraulic pressure thus produced operates incremental rotating device 44 to rotate tool assembly 16 through control device 45 to a desired position. Stabilizers 42 are preferably free to rotate around tool assembly 16 thus acting as a bearing surface for rotation of the tool. The problems with torque and cable damage can thus be eliminated and orientation of tool pads such as used with compensated density or compensated neutron tools can be accomplished to maintain a position to ensure contact with the bore hole wall without centralization. Since normal continuous rotation, circulation, and reciprocation of drill string 14 cannot be accomplished during logging, centralization of the lower section of the drill pipe becomes increasingly dangerous adding to the potential sticking and resulting loss of a portion of drill string 14 and or tool assembly 16. Downhole control of the position of the tool active pads allows much smaller stabilizers to be used, which decreases the potential of sticking and still maintains a close proximity to the well bore wall for other tools.

The device preferably includes means (not shown) for measuring the orientation of the tools so that the position of the tool in the well bore can be determined. For example, it may be desired to orient the active pad of a tool toward the low side of the hole, in which case it is necessary to establish a reference to the vertical plane. A simple gravity potentiometer is sufficient for that purpose when the hole is inclined greater than about 15° from the vertical. Some tools, such as directional tools and dip meters, have accelerometers that establish orientation.

Figure 5A:
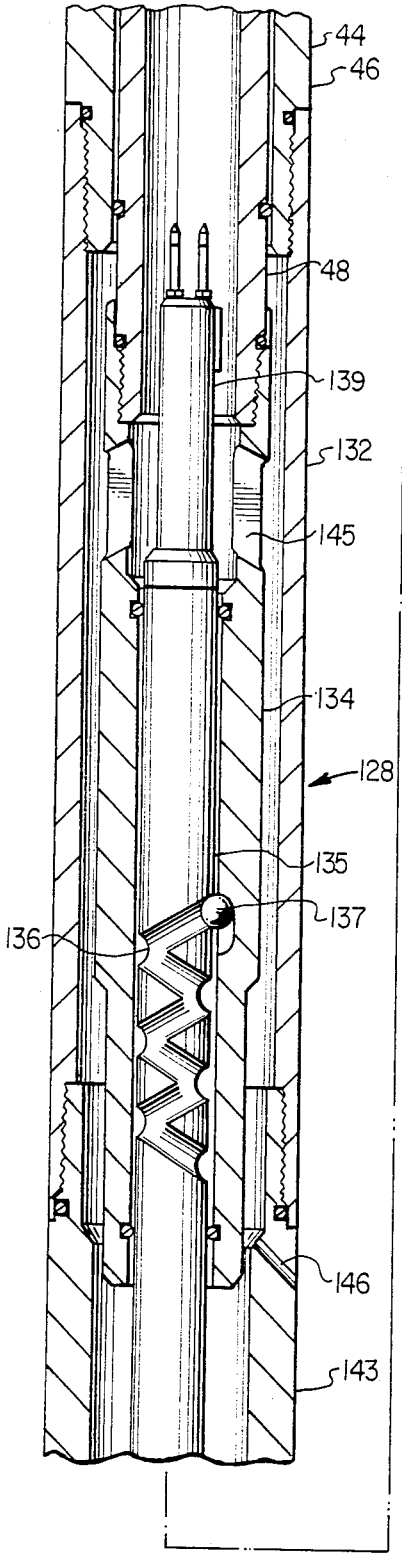
FIGS. 5A–B are sectional views showing an alternative embodiment of the present invention that provides means for extending and retracting various tools of the tool assembly.
Figure 5B:
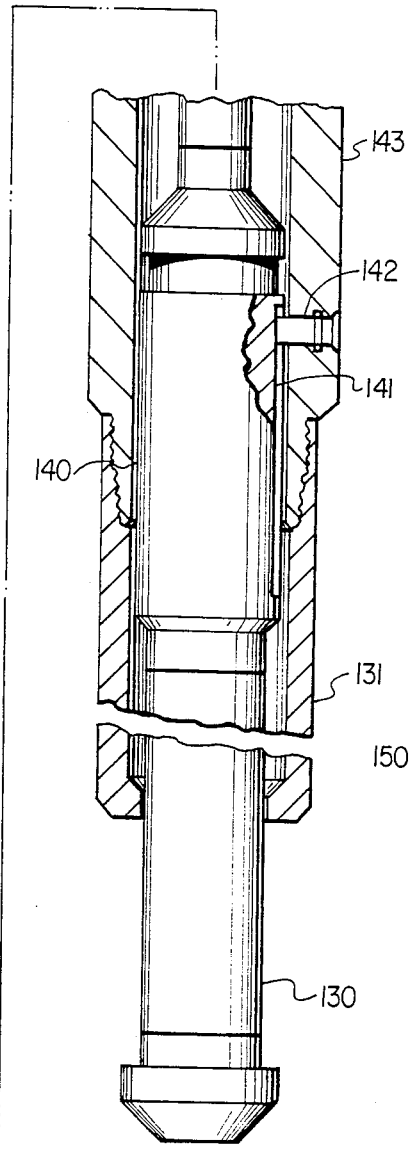

Referring now to FIGS. 5A and 5B, there is shown an alternative control device 128 which is adapted to extend and retract an active part of a tool 130 with respect to a protective sleeve 131. Control device 128 includes a tubular housing 132 threadedly engaged with the lower end of body 46 of rotating device 44. A reversing screw housing 134 is threadedly engaged to the lower end of mandrel 48. A reversing screw 135 is housed within screw housing 134. Reversing screw 135 includes an endless helical screw thread 136 which is engaged with screw housing 34 by a reversing ball 137.

Reversing screw 135 has at its upper end a connector 139 and at its lower end a tool support 140. Tool support 140 has formed therein an axially extending guide slot 141, which is engaged by a guide pin 142 in a port sub 143 connected between housing 132 and protective sleeve 131.

Rotation of mandrel 148 with respect to body 46 causes rotation of screw housing 134 with respect to housing 132. Reversing screw 135 is restrained against rotational movement by the cooperation of guide pin 142 and guide slot 141. Accordingly, rotational movement of mandrel 48, as described above, is translated through reversing screw 135 into axial movement of screw 130. Continued rotation of mandrel 48 causes reversing screw 135 to reciprocate inwardly and outwardly. Screw housing 134 includes a plurality of fluid passages 145 which permit fluid to flow from the interior of screw housing into the annular space between screw housing 134 and housing 132 and out a plurality of ports 146 which developes rotational pressure in port sub 143.

Control device 128 is particularly adapted for use in connection with such tools as perforating or sampling guns, which are projected out of protective sleeve to operate and then retracted prior to recovery. Incremental rotation of apparatus 44 causes tool 130 to advance and then retract.

Figure 6:
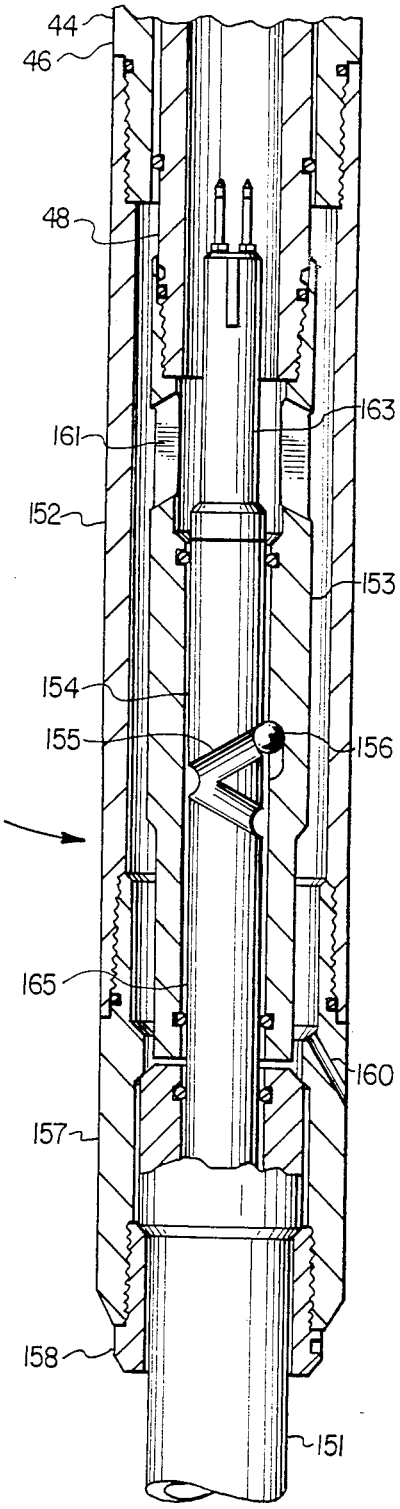
FIG. 6 is a sectional view of a portion of a further alternative embodiment of the present invention which provides means for retracting or extending various devices radially with respect to the tool assembly.

Referring now to FIG. 6, there is disclosed an alternative special control device designed generally by the numeral 150. Special control device 150 is adapted to extend and retract various appurtenances (not shown) to a tool 151. Special control device 150 includes an extension housing 152 threadedly engaged to the lower end of body 46 of rotating apparatus 44 and a reversing screw housing 153 threadedly engaged to the lower end of mandrel 48. A reversing screw 154 is mounted within screw housing 153 and includes a short endless screw thread 155 which is engaged with screw housing 153 by means of a reversing ball 156.

Special control device 150 includes a port sub 157 threadedly engaged to the lower end of housing 152. Tool 151 is retained within port sub 157 by means of a tool retainer 158. Port sub 157 includes a port 160 which receives fluid from fluid passages 161 in screw housing 153, which developes back pressure for rotation.

Reversing screw 154 includes at its upper end a connector 163 and at its lower end a shaft 165. Shaft 169 extends into tool 151 and is adapted to operate various appurtenances (not shown) to move with respect to tool 151. Rotation of mandrel 48 with respect to body 46 of rotating appaatus 44 causes screw housing 153 to rotate with respect to reversing screw 154. The rotation of screw housing 153 with respect to reversing screw 154 causes shaft 165 to reciprocate with respect to tool 151, thereby to operate the appurtenances.

Control device 150 is particularly useful in connection with performing operations such as projecting pads, calipering device, and formation testing equipment radially outwardly with respect to a tool body. Incremental rotation of apparatus 44 is transmitted through reversing screw 154 to extend and retract the devices. Additionally, control device 152 could find use in servicing predetermined formation intervals with select-fire core guns or select-fire perforating guns. For example, a core gun assembly or perforating gun assembly could be mounted to the lower end of control device 152 and control device 152 could be loaded with a ratcheting mechanism interfaced with a multiple percussion firing head on a core gun or perforating gun assembly. With each incremental rotation of rotating device 44, control device 152 will ratchet and release to operate the core gun or perforating gun assembly. Sampling or perforating in different sections of formation could be accomplished on one trip of the conveyor. A wireline would not be necessary for communication in this special application. The foregoing method would replace an existing method wherein tubing conveyed guns are detonated or fire by a pumped down bar. An alternative to the percussion firing head is an electrical firing head interfaced to a rotary contact control mechanism connected to the mandrel 48 of rotating apparatus 44 to provide electric power to a predetermined gun of the assembly during the rotational sequence.

In both types of firing heads, the pumps at the surface will be circulating fluid allowing communication by pressure monitoring at the standpipe when the tool detonations occur. With the pressure transducer mounted in the standpipe, detonation can be detected and recorded. Additional information can be transmitted through the fluid by having one or more orifices that are either restricted or opened at preselected increments of the rotational sequence showing a pressure shift at the surface. These pressure shifts can be used to indicate the status or point of firing selection in the sequence in case of problems or misfires.

A further method of use of the apparatus of the present invention involves a release mechanism operated by rotating apparatus 44. Such system requires that at least a portion of the tool assembly be projected out of a protective sleeve and at least a portion of the tool assembly be centralized in the hole. One such control device arrangement would include a clutch between the protective sleeve and mandrel 48 of incremental rotating apparatus 44 and a release mechanism between mandrel 48 and the tool assembly. The clutch would engage in response to rotation of rotating apparatus 44. The tool assembly can be pumped or lowered into a keyed logging position with sufficient wireline slack left in the conveyor between the side-entry sub and the tool assembly to accommodate the axial movement into logging position. The keyed logging position and clutch allow downhole radial control of portions of the tool assembly that require orientation but not centralization. The portions of the tool that must be centralized, such as sonic or acoustic-type tools, dip meters, and the like, are centralized on both ends and include two standard logging tool knuckle joints, one at the upper end of the centralized tool and one just outside the protective sleeve near the keyed seat. If centralization on the lower end of the tool assembly will provide sufficient accuracy, the upper centralizer and knuckle joint can be removed. In some instances, the keyed seat and mating tool insert can be made in a conical shape allowing movement over a small included angle around their longitudinal axes and eliminating the need for the logging tool knuckle joints. After logging is complete and the side-entry sub has arrived at the surface, the tool assembly can be pulled back into the protective sleeve. In addition to maintaining downhole control both radially and axially, a very important feature of this system is that in the process of logging, rigid tension is maintained throughout the drill string, protective sleeve, and tool assembly. Highly deviated holes require that centralized tools have very strong centralization springs in order to overcome the weight of the tools. Systems wherein a wireline is used as the conveyor, or in which a rigid conveyor is used and the logging tool assembly is secured to the conveyor either by way of a spring or wireline, can cause depth and log correlation problems as well as problems with accuracy from point to point over the interval of the formation. These problems are due to cable stretch. In highly deviated and tight vertical holes, cables stretch results in an ineffective log.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size, and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for performing operations in a well bore, which comprises:

a conveyor adapted for movement into and out of a well bore and for the passage of fluid therethrough;

a fluid operated incremental rotation device including a body connected to said conveyor and a rotating part including a mandrel rotatably mounted in said body, and means positioned in said body for incrementally rotating said mandrel in response to fluid received from said conveyor;

a control device connected to said incremental rotation device and operable by said rotating part of said incremental rotation device;

a tool connected to said control device and operably by said control device to perform downhole operations.

2. The apparatus as claimed in claim 1, wherein said conveyor includes a string of end-to-end connected pipe.

3. The apparatus as claimed in claim 2, including means for establishing electrical connection with said tool.

4. The apparatus as claimed in claim 3, wherein said means for establishing electrical connection includes:

a side-entry sub positioned in said string;

and a cable extending through said side-entry sub into the interior of said string.

5. The apparatus as claimed in claim 1, wherein said control device includes means for transmitting rotation of said rotating part to rotate said tool.

6. Apparatus for performing operations in a well bore, which comprises:

a conveyor adapted for movement into and out of a well bore and for the passage of fluid therethrough;

a fluid operated incremental rotation device connected to said conveyor, said incremental rotation device including a rotating part incrementally rotatable in response to fluid received from said conveyor;

a control device connected to said incremental rotation device and operable by said rotating part of said incremental rotation device, said control device including a housing connected to said incremental rotation device, screw means mounted within said housing and operable to translate rotational motion of said rotating part of said incremental rotating device into linear motion; and, a tool connected to said control device and operable by said control device to perform downhole operations.

7. The apparatus as claimed in claim 6, wherein said tool includes a housing connected to said control device and an active part extendable from said housing responsive to said linear motion.

8. The apparatus as claimed in claim 1, wherein said means for incrementally rotating said mandrel includes:

a drive piston axially slidingly disposed between said body and said mandrel and movable between a first axial position and a second axial position;

and means for transmitting rotational forces to said mandrel in response to axial movement of said drive piston.

9. The apparatus as claimed in claim 8, wherein said rotational force transmitting means includes:

a ratchet sleeve nonrotatably engageable with said mandrel, said ratchet sleeve including a slot having a helical portion;

and a drive pin axially movably carried with said drive piston in engagement with said slot.

10. The apparatus as claimed in claim 9, including means for preventing rotation of said mandrel with respect to said body when said drive piston is in said first position.

11. The apparatus as claimed in claim 9, including means for preventing rotation of said mandrel with respect to said body when said drive piston is in said first and second positions and said drive piston is moving from said second position to said first position.

12. The apparatus as claimed in claim 11, wherein said rotation preventing means includes:

a detent recess formed in said mandrel;

a detent carrier sleeve positioned about said mandrel and nonrotatingly mounted with respect to said tool body, said detent carrier sleeve having a detent aperture;

a detent radially movably carried by said detent carrier sleeve in said detent aperture;

a locking sleeve positioned about said detent carrier sleeve and axially movable with said drive piston, said locking sleeve including a first internal surface engageable with said detent to hold said detent in engagement with said detent recess when said drive piston is in said first position and a radially enlarged second internal surface;

a floating sleeve axially movably positioned about said detent carrier sleeve and within said second internal surface of said locking sleeve, said floating sleeve having an internal surface engageable with said detent to hold said detent in engagement with said detent recess.

13. The apparatus as claimed in claim 9, wherein the nonrotatable engagement of said ratchet sleeve and said mandrel is defined by:

a locking pawl connected to said mandrel;

a locking ratchet formed in said ratchet sleeve and engageable with said locking pawl;

and means for urging said ratchet sleeve axially toward said locking pawl to engage said ratchet with said locking pawl.

14. Apparatus for performing operations in a well bore, which comprises:

a conveyor adapted for movement into and out of a well bore and for the passage of fluid therethrough;

a fluid operated incremental rotation device connected to said conveyor, said incremental rotation device including a cylindrical body connectable at one end to said conveyor and; a rotating part including a cylindrical mandrel rotatably mounted in said body, said mandrel including a plurality of circumferentially spaced apart locking pawls;

a ratchet sleeve axially and rotatably mounted on said mandrel, said ratchet sleeve including a pluraliy of locking ratchet notches engage-able with said locking pawls of said mandrel and said ratchet sleeve including a plurality of slots each having a helical portion;

spring means for urging said ratchet sleeve axially toward said locking pawls;

a drive piston axially alidingly disposed between said body and said mandrel movable between a first axial position and a second axial position;

a plurality of drive pins carried by said drive piston and in engagement with said slots of said ratchet sleeve;

means for preventing rotation of said drive pins with respect to said body;

spring means for urging said drive piston axially toward said first position;

means for prevention rotation of said mandrel with respect to said body when said drive piston is in said first and second positions and moving from said second position to said first position and for allowing rotation of said mandrel when said drive piston is moving from said second position to said first position;

a control device operably connected to said incremental rotation device and operable by said rotating part of said incremental rotation device; and, a tool connected to said control device and operable by said control device to perform downhole operations.

15. The apparatus as claimed in claim 14, wherein said means for preventing rotation of said mandrel with respect to said body includes:

a plurality of detent recesses formed between said locking pawls;

a detent carrier sleeve positioned about said mandrel and nonrotatably mounted with respect to said body, said detent carrier sleeve having a plurality of detent apertures;

a plurality of detents radially movably carried by said detent carrier sleeve;

a locking sleeve positioned about said detent carrier sleeve and axially movable with said drive piston, said locking sleeve including a first internal surface engageable with said detents to hold said detents in engagement with said detent recesses when said drive piston is in said first position and a radially enlarged second internal surface with shoulder defined between said first and second internal surfaces;

a floating sleeve axially movable positioned between said second internal surface of said locking sleeve and said detent carrier sleeve, said floating sleeve having an internal surface engageable with said detents to hold said detents in engagement with said detent recesses;

and means for moving said floating piston into engagement with said detents as said drive piston moves into said second position.

16. A fluid operated apparatus for rotating a logging tool assembly with respect to a pipe string, which comprises:

a body connectable to said pipe sting;

a mandrel rotatably mounted in said body and connectable to said logging tool assembly;

a drive piston axially slidingly disposed between said body and said mandrel and movable between a first axial position and a second axial position with respect to said body;

and means for transmitting rotational forces to said mandrel in response to axial movement of said drive piston.

17. The apparatus as claimed in claim 16, wherein said rotational force transmitting means includes:

a ratchet sleeve nonrotatably engageable with said mandrel, said ratchet sleeve including a slot having a helical portion;

and a drive pin axially movably carried with said drive piston in engagement with said slot.

18. The apparatus as claimed in claim 17, including means for preventing rotation of said mandrel with respect to said body when said drive piston is in said first position.

19. The apparatus as claimed in claim 17, including means for preventing rotation of said mandrel with respect to said body when said drive piston is in said first and second positions and said drive piston is moving from said second position to said first position.

20. The apparatus as claimed in claim 19, wherein said rotation preventing means includes:

a detent recess formed in said mandrel;

a detent carrier sleeve positioned about said mandrel and nonrotatingly mounted with respect to said tool body, said detent carrier sleeve having a detent aperture;

a detent radially movably carried by said detent carrier sleeve in said detent aperture;

a locking sleeve positioned about said detent carrier sleeve and axially movable with said drive piston, said locking sleeve including a first internal surface engageable with said detent to hold said detent in engagement with said detent recess when said dirve piston is in said first position and a radially enlarged second internal surface;

a floating sleeve axially movably positioned about said detent carrier sleeve and within said second internal surface of said locking sleeve, said floating sleeve having an internal surface engageable with said detent to hold said detent in engagement with said detent recess.

21. The apparatus as claimed in claim 17, wherein the nonrotatable engagement of said ratchet sleeve and said mandrel is defined by:

a locking pawl connected to said mandrel;

a locking ratched formed in said ratchet sleeve and engageable with said locking pawl;

and means for urging said ratchet sleeve axially toward said locking pawl to engage said locking ratched with said locking pawl.

22. A fluid operated apparatus for incrementally rotating a logging tool assembly with respect to a pipe string, which comprises:

a cylindrical body connectable at one end to said pipe string;

a cylindrical mandrel rotatably mounted in said body and connectable at one end to said logging tool assembly, said mandrel including a plurality of circumferentially spaced apart locking pawls;

a ratchet sleeve axially and rotatably mounted on said mandrel, said ratchet sleeve including a plurality of locking ratchets engageable with said locking pawls of said mandrel and said ratchet sleeve including a plurality of slots each having a helical portion;

spring means for urging said ratchet sleeve axially toward said locking pawls;

a drive pistion axially slidingly disposed between said body and said mandrel movable between a first axial position and a second axial position;

a plurality of drive pins carried by said drive piston and in engagement with said slots of said ratchet sleeve;

means for preventing rotaton of said drive pins with respect to said body;

spring means for urging said drive piston axially toward said first position;

and means for preventing rotation of said mandrel with respect to said body when said drive piston is in said first and second positions and moving from said second position to said first position and for allowing rotation of said mandrel when said drive piston is moving from said second position to said first position.

23. The apparatus as claimed in claim 22, wherein said means for preventing rotation of said mandrel with respect to said body includes:

a plurality of detent recesses formed between said locking pawls;

a detent carrier sleeve positioned about said mandrel and nonrotatably mounted with respect to said body, said detent carrier sleeve having a plurality of detent apertures;

a plurality of detents radially movably carried by said detent carrier sleeve;

a locking sleeve positioned about said detent carrier sleeve and axially movable with said drive piston, said locking sleeve including a first internal surface engageable with said detents to hold said detents in engagement with said detent recesses when said drive piston is in said first position and a radially enlarged second internal surface with a shoulder defined between said first and second internal surfaces;

a floatng sleeve axially movably positioned between said second internal surface of said locking sleeve and said detent carrier sleeve, said floating sleeve having an internal surface engageable with said detents to hold said detents in engagement with said detent recesses;

and means for moving said floating piston into engagement with said detents as said drive piston moves into said second position.

24. A downhole logging device, which comprises:

a string of end-to-end connected pipe;

a logging tool assembly positioned adjacent an end of said string;

a side-entry sub positioned in said string;

a cable extending through said side-entry sub into the interior of said string and electrically connected to said logging tool assembly;

and means for extending said logging tool assembly with respect to said string, said extending means including, a body connected to said string, a mandrel rotatably mounted in said body, a drive piston axially slidingly disposed between said body and said mandrel, means for transmitting rotational forces to said mandrel in response to axial movement of said drive piston, a logging tool assembly housing connected to said body, a screw housing connected to said mandrel, a screw member threadably engaged with screw housing and operably connected to external said logging tool assembly, and means for preventing rotation of said screw member with respect to said logging tool assembly housing.

25. Apparatus for performing operations in a well bore, which comprises:

a string of end-to-end connected pipe;

a side-entry sub positioned in said string;

a rotating device including a body nonrotatably connected to said string, a rotating part rotatably mounted within said body, and means within said body for rotating said rotating part independent of movement of said string;

a tool operably connected to said rotating part of said rotating device; and, a cable extending through said side entry sub into the interior of said string and electrically connected to said tool.

* * * * *